US005744999A

United States Patent [19]

Kim et al.

[11] Patent Number: 5,744,999

[45] Date of Patent: Apr. 28, 1998

[54] CMOS CURRENT SOURCE CIRCUIT

[75] Inventors: Daejeong Kim, Seoul; Sung Ho Cho, Kyungki-Do, both of Rep. of Korea

[73] Assignee: LG Semicon Co., Ltd., Cheongju, Rep. of Korea

[21] Appl. No.: 589,677

[22] Filed: Jan. 22, 1996

[30] Foreign Application Priority Data

Sep. 27, 1995 [KR] Rep. of Korea ..... 1995-32103

[51] Int. Cl.[6] ..... G05F 1/10

[52] U.S. Cl. ..... 327/543; 327/513; 327/404; 323/312; 323/315

[58] Field of Search ..... 323/313, 315, 323/312; 327/403, 404, 416, 538, 543, 545, 546, 513, 108

[56] References Cited

U.S. PATENT DOCUMENTS

| | | | |
|---|---|---|---|
| 4,359,680 | 11/1982 | Hellums et al. | 323/313 |
| 4,723,108 | 2/1988 | Murphy et al. | 323/315 |
| 4,999,567 | 3/1991 | Morigami | 323/315 |
| 5,034,626 | 7/1991 | Pirez et al. | 327/513 |
| 5,038,053 | 8/1991 | Djenguerian et al. | 327/513 |
| 5,059,890 | 10/1991 | Yoshikawa et al. | 323/315 |
| 5,399,960 | 3/1995 | Gross | 327/513 |
| 5,418,751 | 5/1995 | Kaiser | 365/211 |
| 5,453,679 | 9/1995 | Rapp | 323/313 |
| 5,543,746 | 8/1996 | Kuo | 327/543 |
| 5,563,502 | 10/1996 | Akioka et al. | 323/313 |

*Primary Examiner*—Margaret Rose Wambach
*Assistant Examiner*—Jung Ho Kim
*Attorney, Agent, or Firm*—Fleshner & Kim

[57] ABSTRACT

An improved CMOS current source circuit capable of constantly generating a certain reference voltage irrespective of an analog supplying voltage, a substrate temperature, and a temperature variation, which includes a start unit for driving the CMOS current source circuit in accordance with a start signal; a bias current generating unit driven by the start unit for generating a bias current in accordance with an analog voltage, a substrate voltage, and a temperature variation; a current input unit for inputting a bias current; and a current compensation unit for receiving a bias current through the current input unit and for compensating the bias current in accordance with an analog voltage, a substrate voltage, and a temperature variation and for generating a reference current.

21 Claims, 4 Drawing Sheets

CM OS CURRENT SOURCE CIRCUIT

BACKGROUND OF THE INVENTION

1. Field of the Invention

The present invention relates to a CMOS current source circuit, and particularly to an improved CMOS current source circuit capable of constantly generating a certain reference voltage irrespective of an analog supplying voltage, a substrate temperature, and a temperature variation.

2. Description of the Conventional Art

Generally, in a high speed memory construction, an analog circuit such as a DLL (delay-locked loop) is adopted in order to reduce an access time of the memory. Here, DLL is subjected to a temperature T or a supplying voltage Vdd. Therefore, a current source circuit capable of constantly generating a certain reference current Iref irrespective of the above-mentioned factors is necessary.

FIG. 1 shows a conventional current source circuit, which includes PMOS transistors MP1, MP4, and MP5, PMOS transistors MP2 and MP3, and NMOS transistors MN3 and MN4, each of which is formed with a current mirror.

To begin with, an analog voltage Vdda is supplied to the current source circuit as shown in FIG. 1. In this state, a temperature T is increased, the current I1 can be obtained in accordance with the following expression, when a resistance R1 is applied to the base-emitter Vbe2.

$$I1=Vbe2/R1 \qquad \text{formula 1}$$

Here, the current I1 of the formula 1 is in inverse proportion to temperature because the same is decreased by −2 mV/°C.

In addition, the current I2 is caused when the difference between the base-emitter voltage Vbe2 of the bipolar transistor Q2 and the base-emitter voltage Vbe1 of the bipolar transistor Q1 are applied to the resistance R2. That is, the current I2 is obtained as follows.

$$I2=(Vbe2-Vbe1)/R2=nT/R2 \qquad \text{formula 2}$$

where n denotes a constant irrespective of temperature.

Therefore, the current I2 is in proportion to the temperature increase, and when the NMOS transistor MN4 has the same ratio of "width(w)/length(1)" as the NMOS transistor MN3, the current I3 is the same as the current I2.

In addition, since the PMOS transistors MP1, MP4, and MP5 is formed with a current mirror, the current I3 flows through the PMOS transistor MP1. In addition, since the PMOS transistors MP2 and MP3 are formed with a current mirror, the current I1 flows through the PMOS transistor MP2.

Here, the bias current Ibias is obtained by adding the current I1 and the current I3. That is, it is obtained by the following expression.

$$Ibias=I1+I3=Vbe2/R1+nT/R2 \qquad \text{formula 3}$$

Therefore, when temperature T is increased, since the bias current Ibias is the sum between the current I1 which is decreased in accordance with the increase of the temperature T and the current I2 which is increase in accordance with the decrease of the temperature T, the bias current is constant.

However, since the conventional current source circuit adopts the bipolar transistor which has the emitter of the $P^+$ diffusion layer, the base of n-well, and the collector of the $P^-$ substrate in a n-well formation process in order to generate a constant bias current Ibias, substrate currents are generated.

Therefore, this substrate currents cause variation of substrate voltage in accordance with an internal resistance component, and the substrate voltage varies the threshold voltage Vt, so that the bipolar transistor characteristics are varied, and analog devices which require a constant substrate voltage may be affected by the above-mentioned variations.

SUMMARY OF THE INVENTION

Accordingly, it is an object of the present invention to provide a CMOS current source circuit, which overcome the problems encountered in a conventional CMOS current source circuit.

It is another object of the present invention to provide an improved CMOS current source circuit capable of constantly generating a certain reference voltage irrespective of an analog supplying voltage, a substrate temperature, and a temperature variation.

To achieve the above objects, there is provided a CMOS current source circuit, which includes a start unit for driving the CMOS current source circuit in accordance with a start signal; a bias current generating unit driven by the start unit for generating a bias current in accordance with an analog voltage, a substrate voltage, and a temperature variation; a current input unit for inputting a bias current; and a current compensation unit for receiving a bias current through the current input unit and for compensating the bias current in accordance with an analog voltage, a substrate voltage, and a temperature variation and for generating a reference current.

DETAILED DESCRIPTION OF THE INVENTION

Figure 1:
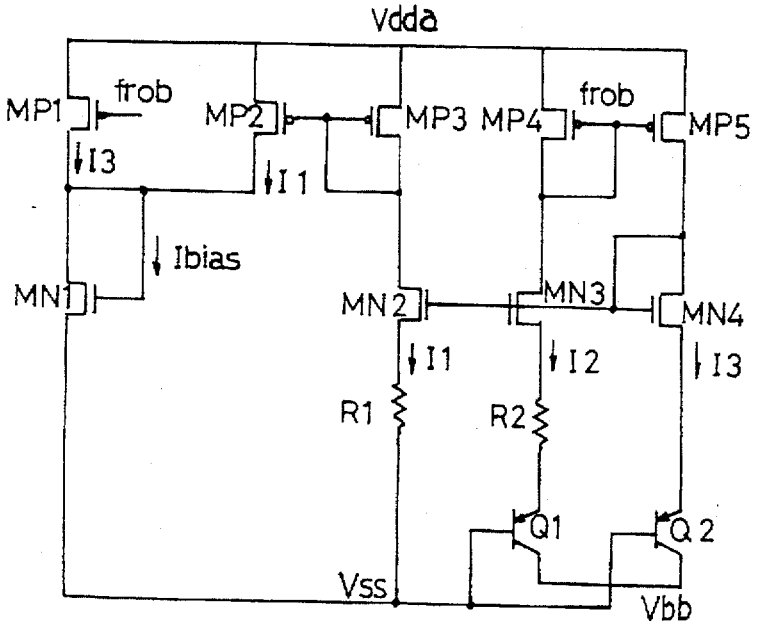
FIG. 1 CONVENTIONAL ART
FIG. 1 is a circuit diagram of a conventional current source circuit.
Figure 2:
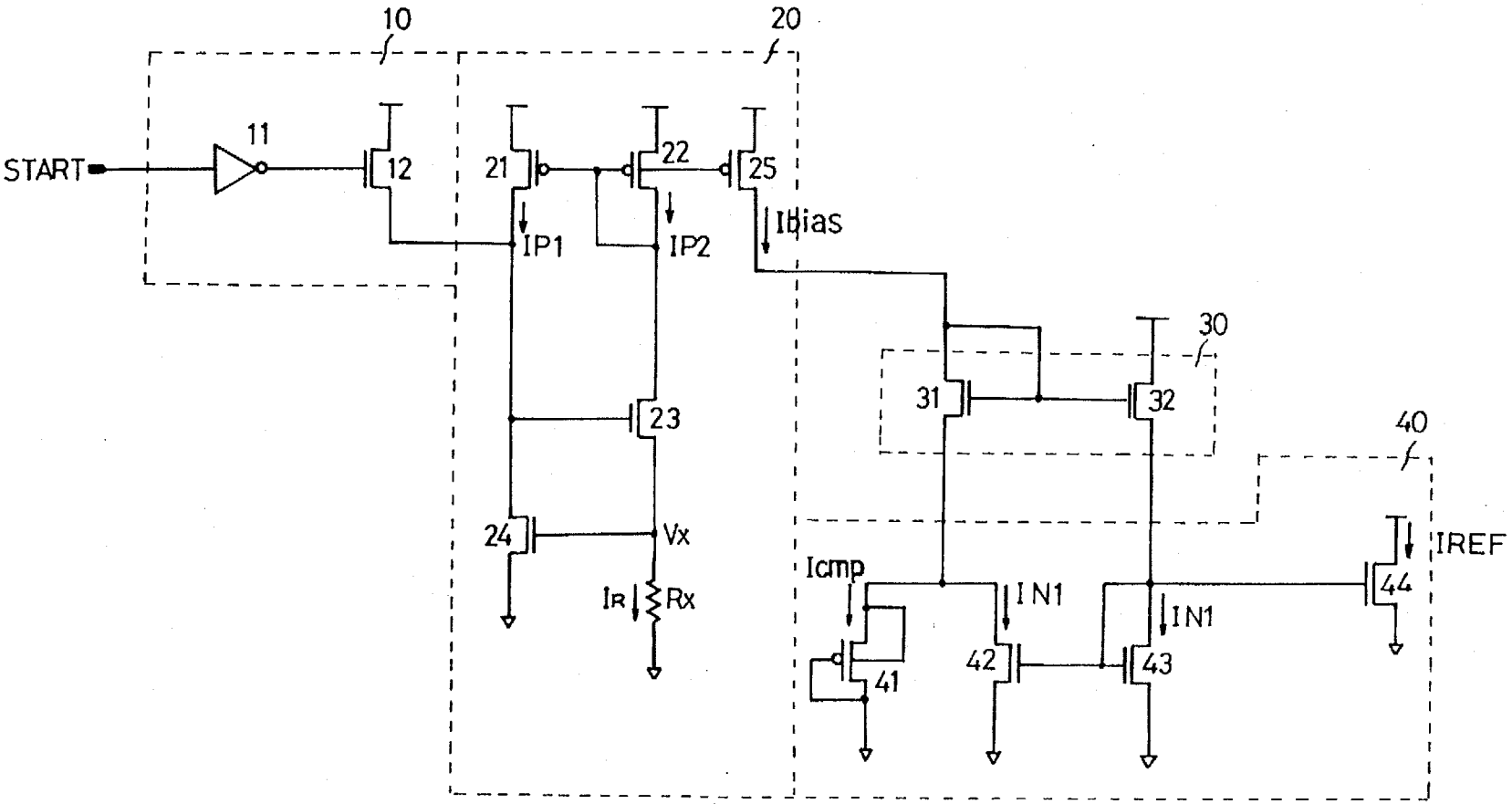
FIG. 2 is a circuit diagram of a CMOS current source circuit according to the present invention.

FIG. 2 shows a CMOS current source circuit, which includes a start unit 10 for driving a CMOS current source circuit in accordance with an externally applied start signal, a bias current generating unit 20 driven by the start unit 10 for generating a bias current Ibias in accordance with an analog voltage Vdda, a substrate voltage Vbb, and a temperature variation T, a current input unit 30 for inputting a bias current Ibias, and a current compensation unit 40 for receiving a bias current Ibias through the current input unit 30 and for compensating the bias current Ibias in accordance with an analog voltage Vdda, a substrate voltage Vbb, and a temperature variation T.

The start unit 10 includes an inverter 11 and a transistor 12. The bias current generating unit 20 includes PMOS transistors 21, 22, and 25 forming a current mirror, an NMOS transistor 23 having the drain connected to the drain of the PMOS transistor 22 and the gate commonly connected to the drain of the PMOS transistor 21, an NMOS transistor 24 having the drain connected to the drain of the PMOS transistor 21, the source connected to the ground, and the gate commonly connected to the source of the NMOS transistor 23, and a resistor Rx connected to the source of the NMOS transistor 23.

The current input unit 30 includes NMOS transistors 31 and 32 which forms a current mirror.

The current compensation unit 40 includes a PMOS transistor 41 having the gate and drain commonly connected to the ground and the source connected to the source of the NMOS transistor 31, NMOS transistors 42 and 43 having the drain connected to the sources of the NMOS transistors 31 and 32, respectively, for forming a current mirror, and an NMOS transistor 44 having the gate connected to the drain of the NMOS transistor 43. In addition, here, all of the above-mentioned elements receives an analog voltage Vdda.

The operation of the CMOS current source circuit will now explained with reference to the accompanying drawings.

To begin with, when a low level start signal is applied to the start unit 10, the inverter 11 applies a high level signal to the gate of the NMOS transistor 12, and the bias current generating unit 20 is driven.

Therefore, currents Ip1 and Ip2 flow through the PMOS transistors 21 and 22, and the NMOS transistor 24 is driven in a full region.

Figure 3A:
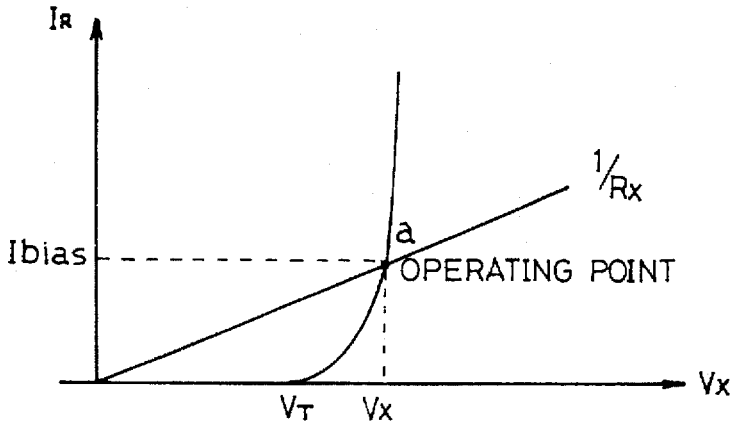
FIGS. 3A and 3B are graphs of a bias current variation caused by a substrate voltage variation of FIG. 2 according to the present invention.

However, when the analog supplying voltage Vdda, the substrate voltage Vbb, and temperature vary, in an assumption that the PMOS transistors 21, 22, and 25 have the same channel ratio "width/length", as shown in FIG. 3A, the bias current Ibias can be checked at an operation point which is defined at a cross point between the current voltage characteristic curve of the NMOS transistor 24 and the characteristic curve of the resistance Rx.

Thereafter, the current compensation unit 40 receives a bias current Ibias through the current input unit 30 and controls a current Icmp flowing to the PMOS transistor 41 and a current In1 flowing to the NMOS transistor 42, so that an expression "reference current Iref=n * In1 (where, n denotes a constant) can be obtained.

Generally, the reference current Iref in a current circuit is irrespective of an analog supplying voltage Vdda and should be constantly maintained to be constant with respect to the substrate voltage Vbb and temperature. The reference current Iref is determined in accordance with a bias current Ibias. The relationship between the bias current Ibias and the above-mentioned elements will now be explained.

To begin with, a voltage Vx related to the resistor Rx of the bias current generating unit 20 can be expressed as follows.

$$Vx=Rx*Ir,\ Ir=1/Rx*Vx \qquad \text{formula 4}$$

In addition, the currents Ip1 and Ip2 flowing through the PMOS transistors 21 and 22 can be expressed as follows.

$$Ip1=Ip2=Kp/2*W/L(Vx-Vt)^2=Ir \qquad \text{formula 5}$$

Therefore, as shown in FIG. 3A, the operation point "a" and the bias current Ibias are obtained in accordance of the formulas 4 and 5. Here, the bias current Ibias is irrespective of the analog supplying voltage Vdd.

Thereafter, the relationship between the substrate Vbb and the bias current Ibias is as follows. The threshold voltage Vt of the NMOS transistor 24 is subjected to fabrication variations and the substrate voltage variation, and is obtained by the following expression.

$$Vt=Vto+A(\sqrt{B+|Vbb|}-\sqrt{B}) \qquad \text{formula 6}$$

where A and B denote a constant.

Figure 3B:
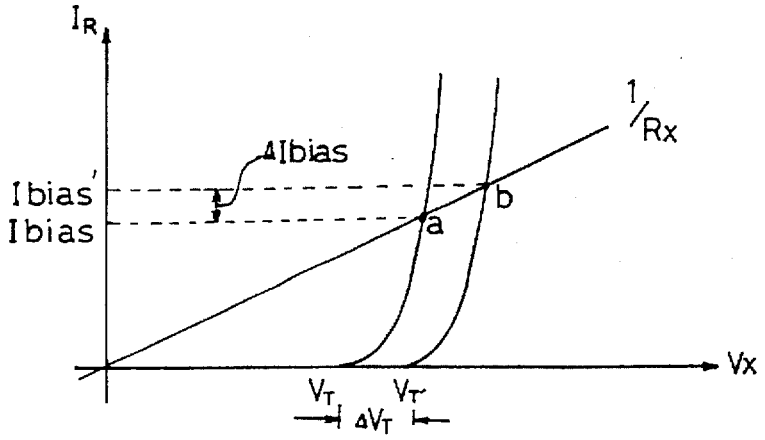

Therefore, as shown in FIG. 3B, when the substrate voltage |Vbb| is increased, the threshold voltage Vt is increased by ΔVt (Vt to Vt'), and the bias current Ibias, which varies from an operation point "a" to "b" in accordance with the increase ΔVt, is increased by ΔIbias.

Thereafter, the bias current Ibias' which is increased by ΔIbias is inputted to the current compensation unit 40 through the current input unit 30 and is divided into two parts, of which one compensation current Icmp flows to the PMOS transistor 41 and the other current In1 flows to the NMOS transistor 42.

Therefore, when increasing/decreasing the current Icmp flowing through the PMOS transistor 41 by varying the ratio "width/length" of the channel of the PMOS transistor within a range of −2~ϕ1.4 v of the substrate voltage Vbb so that the current ΔIcmp is coincident to the current ΔIbias, the current In1 flowing through the NMOS transistor 42 can be constant in accordance with an expression "Current In1=Ibias−Icmp".

Therefore, although the substrate voltage Vbb is increased/decreased in accordance with an expression "Reference current Iref=n*Ini (n is a constant)", the reference current Iref can be constant. In this case, the bias current generating unit 20 can be substituted by a PMOS transistor 41 on the basis of the same purpose.

Thereafter, when temperature is increased irrespective of the temperature T and the bias current Ibias, the resistance Rx varies by about +1400ppm, the threshold voltage Vt varies by about −1000 ppm, and the temperature constant varies about −4000 ppm.

Figure 4A:
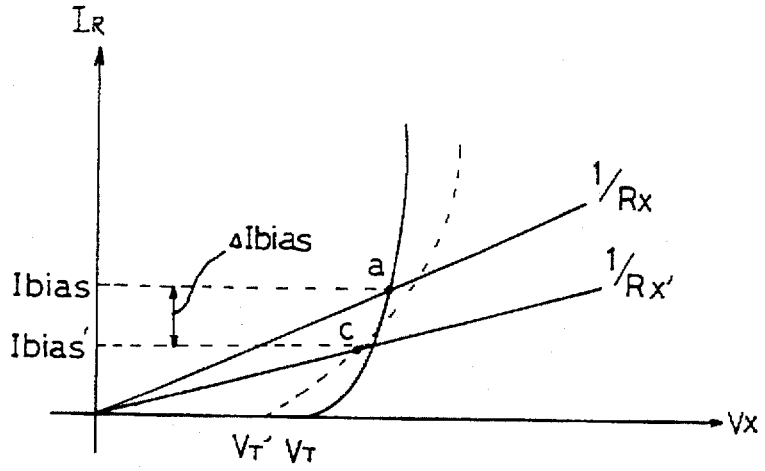
FIGS. 4A and 4B are graphs of a bias current variation caused by a temperature variation of FIG. 2 according to the present invention.

In addition, when temperature is increased, the operation points of the formulas 4 and 5, as shown in FIG. 4A move from "a" to "c", and the bias current in accordance the movement is decreased by ΔIbias.

Thereafter, the bias current Ibias' which is decreased by ΔIbias is inputted to the current compensation unit 40 through the current input unit, and is divided into two parts, of which one current Icmp flows to the PMOS transistor 41 and the other current Ini flows to the NMOS transistor 42.

Figure 4B:
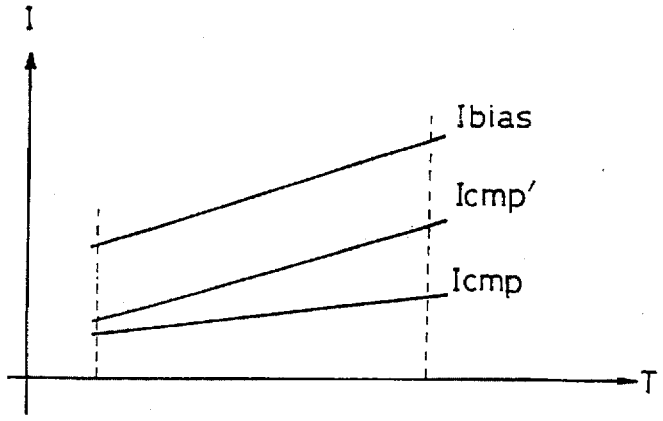

Therefore, it is possible to vary the current from Icmp to Icmp' by controlling the ratio "width/length" of the channel of the PMOS transistor 41 in accordance with the expression "current Icmp=Kp/2*W'L(Vsg−|Vtp|)$^{1/2}$ and by varying the range of the variation without changing the temperature characteristic of the current Icmp. That is, when the current Icmp at O° C.~100° C. is varied from 1 μA to 0.9 μA, that is, it is reduced by 0.1 μA(10%), the current Icmp' is reduced by 1 μA(10%) from 10 μA to 9 μA, and the current Icmp' as shown in FIG. 4B, is increased or decreased by the same rate as the bias current Ibias, so that the current In1 flowing through the NMOS transistor 42 can be constant.

Therefore, since the current Ini can be constant in accordance with the expression "Reference current Iref=n*In1 (n denotes a constant), the reference current Iref is constant in accordance with a temperature variation. In addition, the resistance Rx of the bias current generating unit 20 has a positive temperature coefficient. Here, the PMOS transistor 41 can be substituted by a resistor Rx adopted in the bias current generating unit 20 for the same purpose of the present invention.

However, when the resistance Rx of the bias current generating unit 20 has a negative temperature coefficient, only the resistor is used instead of the PMOS transistor 41.

In addition, a method of constantly maintaining the reference current Iref in accordance with a temperature variation can be adopted so as to vary the temperature coefficient of the bias current Ibias by controlling the ratio between the PMOS transistors 21 and the PMOS transistor 22 in the bias current generating unit 20.

As described above, the CMOS current source circuit is directed to constantly generating a certain reference voltage irrespective of an analog supplying voltage, a substrate temperature, and a temperature variation by positively offsetting the variation of the bias current due to a substrate voltage variation and a temperature variation and by generating a constant reference current.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. A current source circuit comprising:

a bias current generating circuit having a first current mirror to generate a bias current in response to a first signal;

a current compensation unit coupled to receive said bias current and having first, second and third transistors, said first transistor generating an offset current such that a first current flowing through said second transistor remains substantially constant, wherein said third transistor is coupled to said second transistor, and a reference current, which is substantially constant, flows through said third transistor; and a current input unit to provide the bias current to said current compensation unit.

2. The circuit of claim 1, wherein said bias current generating circuit further comprises fourth and fifth transistors and a resistor, wherein said fourth and fifth transistors are coupled to said first current mirror, said resistor and one another.

3. The circuit of claim 1, wherein said bias current generating circuit includes:

a fourth transistor having first and second electrodes and a control electrode;

a fifth transistor having first and second electrodes and a control electrode; and a resistor coupled to the control electrode of said fifth transistor and said first electrode of said fourth transistor, wherein the second electrode of said fifth transistor is coupled to the control electrode of said fourth transistor and said first current mirror, and said second electrode of said fourth transistor is coupled to the current mirror.

4. The circuit of claim 2, wherein said first current mirror comprises:

a sixth transistor having first and second electrodes and a control electrode, the first electrode being coupled to receive the first signal and being coupled to said fourth and fifth transistors;

a seventh transistor having first and second electrodes and a control electrode, its control electrode being coupled to its second electrode and said fourth transistor; and an eighth transistor having first and second electrodes and a control electrode, its control electrode being coupled to said seventh transistor, and providing the bias current at its second electrode.

5. The circuit of claim 3, wherein said current mirror comprises sixth, seventh and eighth transistors coupled in a current mirror configuration with control electrodes of said sixth and seventh transistors being commonly coupled, and said eighth transistor is coupled to said seventh transistor, said sixth transistor being coupled to said fourth and fifth transistors and said seventh transistor being coupled to said fourth transistor, and said eighth transistor providing the bias current.

6. The circuit of claim 1, wherein said current input unit comprises a ninth transistor coupled to receive the bias current and providing the bias current to said first and second transistors in response to the bias current.

7. The circuit of claim 1, wherein said current compensation unit further comprises an eleventh transistor coupled to said second and third transistors.

8. The circuit of claim 7 further comprising a current input unit including ninth and tenth transistors, each having first and second electrodes and a control electrode, the control electrodes of said ninth and tenth transistors being commonly coupled to receive the bias current, wherein the first electrode of said ninth transistor is coupled to said first and second transistors, and the second electrode of said ninth transistor is coupled to receive the bias current, and the first electrode of said tenth transistor is coupled to said eleventh transistor.

9. The circuit of claim 8, wherein said eleventh transistor has first and second electrodes and a control electrode, the second electrode of said eleventh transistor being coupled to its control electrode, said tenth transistor and said third transistor, and the control electrode of said eleventh transistor being coupled to said second transistor.

10. The circuit of claim 9, wherein the reference current has a magnitude which is proportional to the first current flowing through said second transistor.

11. The circuit of claim 10, wherein said second and eleventh transistors form a second current mirror.

12. The circuit of claim 1, wherein said first transistor includes first and second electrodes, and a control electrode, its first electrode being coupled to a substrate terminal and coupled to receive said bias current, and its second and control electrodes are coupled to each other.

13. The circuit of claim 1 further comprising a start unit coupled to said bias current generating circuit to generate said first signal, said start unit having an inverter to receive an external start signal; and a twelfth transistor coupled to said inverter and said first current mirror to provide said first signal to said bias current generating circuit.

14. A current source circuit comprising:

a) a bias current generating circuit having i) a first current mirror to generate a bias current in response to a first signal, ii) a first resistor coupled to said first current mirror, and iii) a first field effect transistor coupled to said first resistor and said first current mirror; and b) a current compensating unit receiving said bias current generated by said first current mirror, said current compensation unit having i) a second current mirror, ii) means for offsetting current variations of said bias current, said bias current being split between said means and said second current mirror, said means generating an offset current which offsets variations in said bias current such that a first current flowing through said second current mirror remains substantially constant, and iii) a second field effect transistor coupled to said second current mirror, and a reference current, proportional to said first current, flowing through said second field effect transistor, such that said reference current is substantially constant.

15. The circuit of claim 14, wherein said offset current generating means comprises one of a) a third field effect transistor when said first resistor has a positive temperature coefficient, and having a gate and drain commonly coupled and a substrate terminal coupled to a source for compensating said bias current, and b) a second resistor when said first resistor has a negative temperature coefficient.

16. The circuit of claim 14, wherein said bias current generating means further comprises a fourth field effect transistor coupled to said first current mirror, said first field effect transistor and said first resistor.

17. The circuit of claim 14 further comprising a current input unit coupled to said bias current generating circuit for providing said bias current to said current compensation unit, said current input unit having fifth and sixth field effect transistors, each having first and second electrodes and a control electrode, the control electrodes of said fifth and sixth field effect transistors being commonly coupled to receive the bias current, wherein the first electrode of said fifth transistor is coupled to said offset current generating means and said second current mirror, and the second electrode of said fifth field effect transistor is coupled to said first current mirror for receiving the bias current, and the first electrode of said sixth field effect transistor is coupled to said second current mirror and said second field effect transistor.

18. The circuit of claim 14 further comprising a start unit coupled to said bias current generating circuit to generate said first signal, said start unit having an inverter to receive an external start signal; and a seventh transistor coupled to said inverter and said first current mirror to provide said first signal to said bias current generating circuit.

19. The circuit of claim 2, wherein said resistor has a positive temperature coefficient.

20. The circuit of claim 2, wherein said offset current is adjusted by controlling a ratio of a channel of said first transistor.

21. The circuit of claim 2, wherein said first transistor is a PMOS transistor.

* * * * *